United States Patent [19]

Hammes

[11] 4,023,679

[45] May 17, 1977

[54] PLASTIC BARREL

[75] Inventor: Theo Hammes, Cologne, Germany

[73] Assignee: Mauser Kommanditgesellschaft, Bruhl, Germany

[22] Filed: Apr. 1, 1975

[21] Appl. No.: 564,141

[30] Foreign Application Priority Data

Apr. 5, 1974 Germany ..... 7411989[U]

[52] U.S. Cl. ..... 206/504; 206/509; 220/5 R; 220/66

[51] Int. Cl.² ..... B65D 21/00; B65D 7/02; B65D 7/42

[58] Field of Search ..... 206/503, 504, 509, 510; 220/3, 66, 70, 5 R, 23.4

[56] References Cited

UNITED STATES PATENTS

| | | | |
|---|---|---|---|
| 2,120,487 | 6/1938 | Conner | 220/66 |
| 2,144,069 | 1/1939 | Lear | 206/504 |
| 3,474,928 | 10/1969 | Hurtt | 220/23.4 X |
| 3,547,299 | 12/1970 | Kepple | 206/503 |
| 3,889,839 | 6/1975 | Simon et al. | 220/66 X |

FOREIGN PATENTS OR APPLICATIONS

| | | | |
|---|---|---|---|
| 1,207,017 | 9/1970 | United Kingdom | 215/10 |

*Primary Examiner*—William Price
*Assistant Examiner*—Steven M. Pollard
*Attorney, Agent, or Firm*—Michael J. Striker

[57] ABSTRACT

A blow molded synthetic thermoplastic barrel one end wall of which has an eccentric opening surrounded be a ring-shaped mouth which, in turn, is surrounded by an arcuate groove having two open ends. The opening can be closed by a cover whose outer side is then flush with the outer surface of the major portion of the one end wall. Such outer surface is surrounded by a bead which can surround the other end wall of a second container when the two containers are stacked end-to-end. For the stacking of several containers side-by-side, the circumferential wall of the barrel has two longitudinally extending flats located diametrically opposite each other. The circular end portions of the flats extend into the domed end portions of the circumferential wall and close to the respective end walls.

10 Claims, 4 Drawing Figures

PLASTIC BARREL

BACKGROUND OF THE INVENTION

The present invention relates to containers in general, especially to barrels which consist (either entirely or at least in part) of synthetic thermoplastic material and are produced by blow molding. More particularly, the invention relates to improvements in barrels which can be stacked on top of each other and/or side-by-side to occupy a minimum of space in a vehicle, in storage, on a pallet or on another device which serves for simultaneous transfer of several barrels. Still more particularly, the invention relates to improvements in the design and dimensioning of that end wall of a barrel which is normally the top end wall thereof and has one or more openings for admission and/or evacuation of flowable materials.

It is already known to provide the circumferential wall of a barrel with two flattened portions (hereinafter called flats for short) which render it possible to place several barrels side-by-side so that the flats of neighboring barrels are adjacent to each other. This reduces the space requirements when the barrels are placed in storage, into the van or onto the platform of a vehicle, or onto a pallet or an analogous device for simultaneous transfer of several barrels. As a rule, the flats extend lengthwise of the barrel and may be provided with plane or concave (inwardly bulging) external surfaces. The circumferential wall of the barrel has two domed end portions which taper toward the respective end walls, and the ends of flats normally extend into the respective domed portions of the circumferential wall.

The convexity of the major portions of the circumferential wall enables the barrel to take up substantial stresses when it constitutes the lower or lowermost barrel of a stack of two or more superimposed barrels, i.e., of a stack of barrels which are disposed end-to-end. Such convexity of the major portion of the circumferential wall imparts to the barrel a tendency to bulge outwardly when subjected to axial stresses, i.e., axial stresses cannot cause a cave-in and a resulting collapse of the barrel. As a rule, axial stresses will tend to enlarge the cross-sectional area of the central portion of the barrel, and the thus developing radial stresses are readily taken up by the material of the circumferential wall the major portion of which is curved in the axial as well as in the circumferential direction.

Similar observations apply for the flats. When the top end wall of the barrel carries a heavy load, the resulting axial stresses produce circumferential stresses in the material of the flats, and such circumferential stresses are readily absorbed by the flats, especially by flats whose outer surfaces are concave in the axial as well as in the circumferential direction of the barrel.

Barrels of the just outlined character are produced often by blow molding, in many sizes and shapes, i.e., they range from relatively small casks to large containers with a capacity of up to and in excess of 120 liters. Such containers can be used for storage of liquids and/or granular materials.

A serious drawback of presently known plastic barrels or analogous containers is that they cannot be readily stacked on top of each other without danger of slippage and that they cannot be readily manipulated by attendants or by automatic transfer apparatus.

SUMMARY OF THE INVENTION

An object of the invention is to provide a novel and improved container, particularly a blow molded plastic barrel, which can be readily grouped or arranged with similar containers, either side-by-side or on top of each other, to occupy a miminum of space and to reduce the likelihood of slippage of containers which are disposed end-to-end.

Another object of the invention is to provide a novel and improved end wall for a plastic barrel.

A further object of the invention is to provide a plastic barrel having a novel and improved end wall which is designed with a view to allow for safe stacking of several identical barrels end-to-end, i.e., on top of each other, without slippage and without damage to the part which defines the material admitting and/or evacuating opening.

An additional object of the invention is to provide a novel and improved circumferential wall for a plastic barrel which, save for the cover or closure, consists of a single piece of blow molded synthetic plastic material.

A further object of the invention is to provide a plastic barrel which can be stacked with similar barrels, either in one or more rows or on top of each other, to occupy less room than heretofore known barrels of identical capacity, and which can stand substantial axial and/or radial stresses.

The invention is embodied in a container, particularly in a blow molded barrel consisting at least in part of synthetic thermoplastic material, which comprises a circumferential wall having two stacking flats disposed opposite each other, a first end wall at one end of the circumferential wall, a second end wall at the other end of the circumferential wall, and a removable cover or closure for an eccentric opening in one of the end walls (preferably in the top end wall). The one end wall has a preferably flat outer surface which is normal to the axis of the container, the aforementioned opening, a preferably circular ring-shaped mouth surrounding the opening, and an arcuate groove surrounding at least a portion of the mouth and preferably having two open ends in the adjacent end portion of the circumferential wall. The cover is detachably secured to the mouth or to another portion of the one end wall and has an outer side which is substantially or exactly flush with the outer surface of the one end wall.

At least the one end wall has a preferably circular outline and the internal diameter of the mouth preferably equals or at least approximates the radius of the one end wall.

A circumferential bead can extend from the one end wall beyond its outer surface to serve as a locating means for the preferably circular other end wall of a similar second container when the two containers are stacked end-to-end.

The novel features which are considered as characteristic of the invention are set forth in particular in the appended claims. The improved container itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
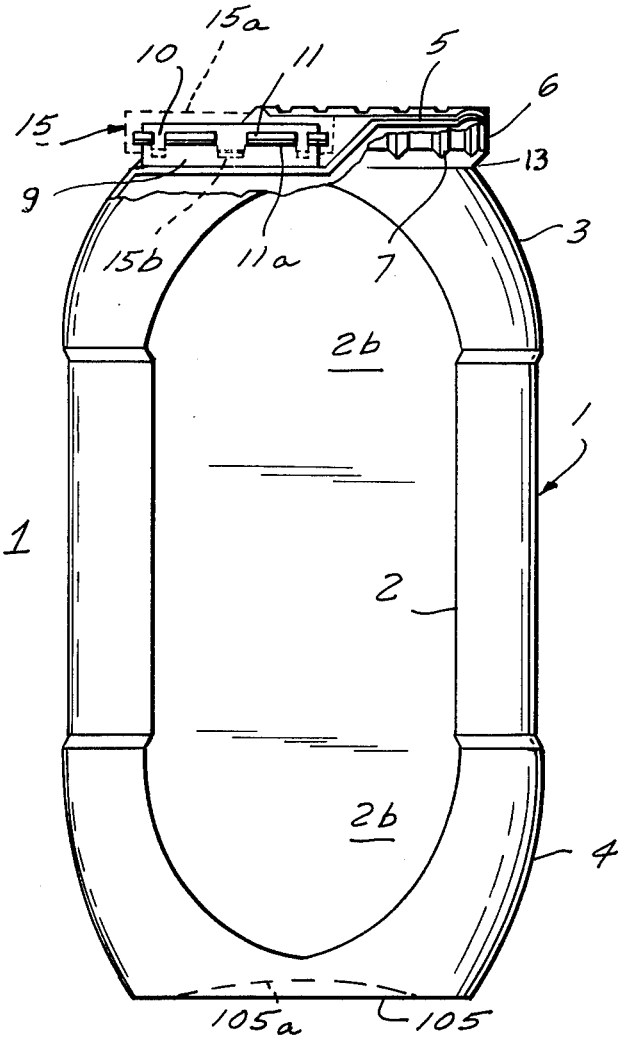
FIG. 1 is a side elevational view of a container which embodies the invention, the cover for the opening in the one end wall being indicated by broken lines.
Figure 3:
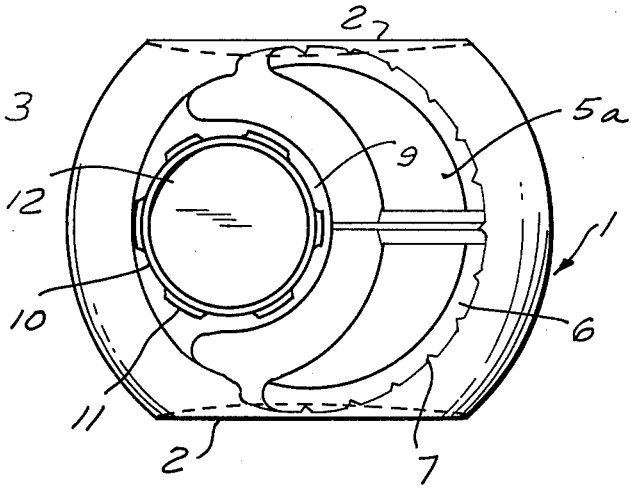
FIG. 3 is a plan view of the container, with the cover removed.
Figure 2:
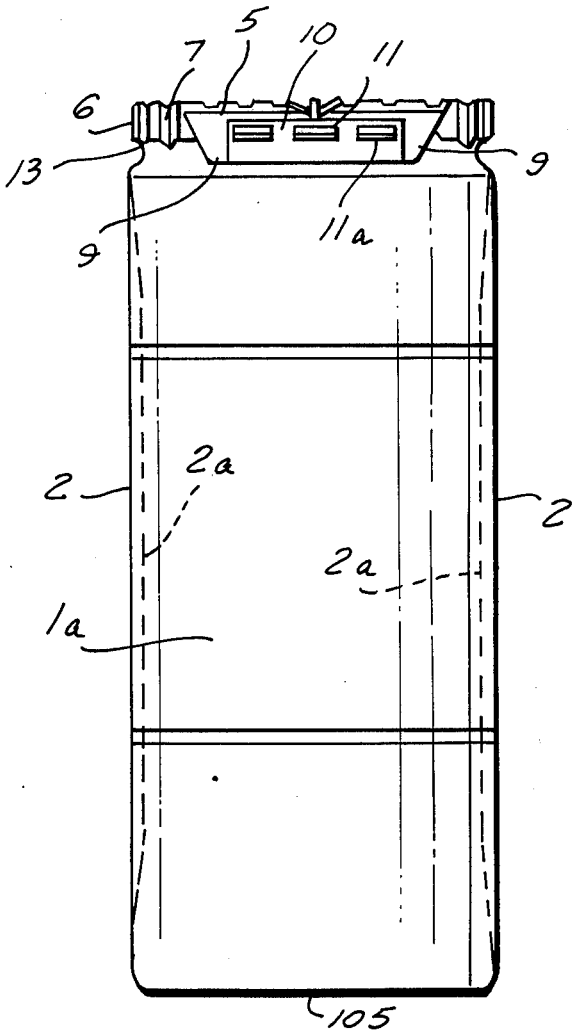
FIG. 2 is a side elevational view of the container, with the cover removed.

Referring first to FIGS. 1 to 3, there is shown an upright container, preferably a blow molded barrel consisting of synthetic thermoplastic material. The barrel has a circumferential wall 1, a bottom end wall 105, and a top end wall 5. The circumferential wall 1 has two flats 2 which are disposed opposite each other and whose outer sides may be slightly concave in the longitudinal as well as in the circumferential direction of the barrel (see the broken lines 2*a* in FIG. 2). The circumferential wall further comprises a substantially cylindrical central portion 1*a* and two domed end portions 3, 4 which taper toward the respective end walls 5 and 105. The end walls 5 and 105 have a substantially circular outline. This is shown in FIG. 3 for the top end wall 5. The outer side of the bottom wall 105 may be slightly concave as indicated by the broken line 105*a* shown in FIG. 1.

Figure 4:
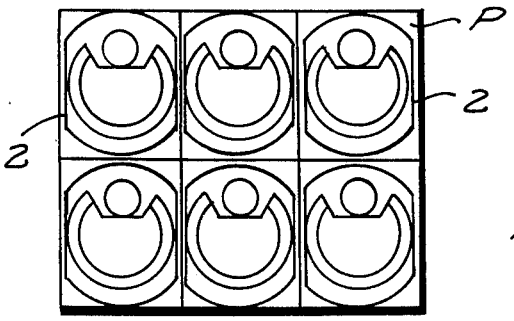
FIG. 4 is a plan view of a pallet with six containers disposed side-by-side in two rows.

The end portions 2*b* of the flats 2 are rounded, as at 2 *b*, and extend into the respective end portions 3, 4 of the circumferential wall 1 and preferably close to the respective end walls. The flats 2 allow for the stacking of a plurality of identical barrels side-by-side in one or more rows and in a small area, e.g., on a rectangular pallet P shown in FIG. 4. In each of the two rows shown in FIG. 4, the two flats of the centrally located barrel are adjacent to the flats of the neighboring outer barrels.

The top end wall 5 of the barrel has an eccentric opening 12 surrounded by a substantially ring-shaped mouth 10 having an inner diameter which equals or approximates the radius of the top end wall 5. The mouth 10 is surrounded by an arcuate groove 9 with two ends (see particularly FIG. 2). The major part of the outer surface 5*a* of the top end wall 5 is surrouned by an arcuate marginal portion or bead 6 having a serrated peripheral surface (see the notches 7). The bead 6 surrounds the bottom end wall 105 of a similar second barrel (not shown) when the two barrels are stacked end-to-end, i.e., on top of each other. The bead 6 of the lower barrel then prevents uncontrolled shifting of the upper barrel. The bottom end wall 105 of the upper barrel then rests on the outer surface 5*a* of the top end wall 5 of the lower barrel and also on the outer face 15*a* of a cover or cap 15 (indicated by broken lines) which can be used to close and/or seal the opening 12. Thus, when the cover 15 is properly attached to the top end wall 5, its outer side 15*a* is flush or nearly flush with the outer surface 5*a*. The marginal portion of the cover 15 has downwardly extending projections or claws 15*b* which can be placed between the external projections or lugs 11 of the mouth 10 in at least one angular position of the cover 15. The cover 15 is then rotated relative to the mouth 10 to a different angular position in which the inwardly extending prongs at the lower ends of its claws 15*b* bear against the cam faces 11*a* at the undersides of the adjacent lugs 11, i.e., the lugs are interlinked with the claws, whereby the inner side of the cover 15 is biased against the top edge face of the mouth 10 to insure a satisfactory sealing action. The cam faces 11*a* preferably constitute ramps along which the prongs of the claws 15*b* slide during angular movement of the cover 15 to and from the position in which the cover is detachable from the mouth 10.

The end portions of the bead 6 on the top end wall 5 extend downwardly to the level of the apices of upper round portions 2*b* of the flats 2 (see FIG. 1), i.e., into the domed upper end portion 3 of the circumferential wall 1. The bead 6 is located immediately above an arcuate constriction 13 of the domed end portion 3; such constriction allows for convenient manipulation of the barrel, e.g., by a fork lift truck. The notches 7 in the peripheral surface of the bead 6 also contribute to convenience of manipulation of the barrel. The notches 7 are preferably equally spaced from each other.

If desired, the cover 15 can be replaced with a modified cover which need not be rotated relative to the mouth 10 in order to provide a reliable closing or sealing action. The claws 15*b* are then replaced with claws having outwardly extending prongs at their lower ends. A piece of wire or the like which is convoluted around the mouth 10 in the region of the cam faces 11*a* on the lugs 11 bears against the cam faces 11*a* and urges the outwardly extending prongs of the claws downwardly so that the inner side of the cover is urged against the top edge face of the mouth.

An advantage of the improved tap end wall 5 is that it can be formed with a relatively large opening 12 (which is particularly desirable when the barrel is to store granular materials). Moreover, and in spite of the relatively large diameter of the internal surface of the mouth 10, a barrel which is placed on top of the end wall 5 is held against tilting with a high degree of reliability because the relatively large outer surface 5*a* is flush with the relatively large outer side 15*a* of the properly applied cover 15 so that they together provide a relatively large supporting area for the bottom wall of the upper barrel. The eccentric placing of the opening 12 insures that the entire contents of the barrel can be readily dispensed, even if the barrel contains granular or pulverulent material.

The top end wall 5 resembles a relatively shallow dish with an upturned marginal portion or bead 6 and a flat bottom surface 5*a*.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A container, particularly a blow molded barrel consisting at least in part of synthetic thermoplastic material, comprising a circumferential wall having two stacking flats disposed opposite each other; a first end wall at one end of said circumferential wall; a second end wall at the other end of said circumferential wall, one of said end walls having an outer stacking surface, a circumferential bead having a serrated peripheral surface and extending outwardly beyond said outer surface so that it can surround the other end wall of a similar second container when the two containers are stacked end-to-end, an eccentric opening, a mouth surrounding said opening, and an arcuate groove surrounding at least a portion of said mouth; and a cover detachably secured to said one end wall to close said opening, said cover having an outer substantially planar stacking side which is at least substantially flush with and constitutes an extension of said outer surface of said one end wall so that a similar second container can be supported by said outer stacking surface of said one end wall and also by said outer stacking side of said cover when the two containers are stacked end-to-end.

2. A container as defined in claim 1, wherein said one end wall has a substantially circular outline and said mouth includes an internal surface surrounding said opening and having a substantially circular outline, the diameter of said internal surface approximating the radius of said one end wall.

3. A container as defined in claim 1, wherein said groove has two open ends.

4. A container as defined in claim 1, wherein said one end wall has a circumferential bead extending outwardly beyond said outer surface so that it can surround the other end wall of a similar second container when the two containers are stacked end-to-end.

5. A container as defined in claim 4, wherein said circumferential wall has domed end portions adjacent to and tapering toward the respective end walls, each of said flats having two substantially rounded end portions extending into the respective domed end portions of said circumferential wall, said bead having portions closely adjacent to the respective rounded end portions of said flats.

6. A container as defined in claim 4, wherein said circumferential wall has a substantially annular constriction adjacent to said bead.

7. A container as defined in claim 1, wherein said flats are elongated, as considered in a direction from the one toward the other of said end walls, and said circumferential wall has domed end portions adjacent to the respective end walls, said flats having portions extending into said domed end portions of said circumferential wall.

8. A container as defined in claim 7, wherein said cover and said mouth have projections which are interlinked with each other in at least one first angular position of said cover with respect to said mouth and are turnably disengaged from each other in at least one second angular position of said cover with respect to said mouth.

9. A container as defined in claim 1, wherein said end walls are round and said one end wall has a substantially annular bead extending said outer surface thereof and having an inner diameter at least slightly exceeding the diameter of the outer end wall.

10. A container as defined in claim 1, wherein said serrated peripheral surface of said bead is comprised of a plurality of equally-spaced notches for facilitating the transport of the container.

* * * * *